US008525731B2

(12) United States Patent
Ju et al.

(10) Patent No.: US 8,525,731 B2
(45) Date of Patent: Sep. 3, 2013

(54) SMALL ANTENNA USING SRR STRUCTURE IN WIRELESS COMMUNICATION SYSTEM AND METHOD FOR MANUFACTURING THE SAME

(75) Inventors: Jeongho Ju, Seoul (KR); Jae-Ick Choi, Daejeon (KR); Wangjoo Lee, Daejeon (KR); Dong-Ho Kim, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 455 days.

(21) Appl. No.: 12/913,985

(22) Filed: Oct. 28, 2010

(65) Prior Publication Data

US 2011/0128187 A1 Jun. 2, 2011

(30) Foreign Application Priority Data

Nov. 30, 2009 (KR) ..... 10-2009-0117393

(51) Int. Cl.
*H01Q 1/38* (2006.01)

(52) U.S. Cl.
USPC ..... 343/700 MS; 343/742; 343/867

(58) Field of Classification Search
USPC ..... 343/700 MS, 741, 742, 866, 867
See application file for complete search history.

(56) References Cited

U.S. PATENT DOCUMENTS 5,057,803 A * 10/1991 Ooi et al. ..... 333/204
5,892,490 A 4/1999 Asakura et al.
6,600,451 B2 * 7/2003 Mimura et al. ..... 343/741
8,314,740 B2 * 11/2012 Blumberg, Jr. ..... 343/741
2006/0145927 A1 7/2006 Choi et al.

FOREIGN PATENT DOCUMENTS

KR 10-2006-0064473 A 6/2006
KR 2006-0064457 A 6/2006
KR 2009-0081256 A 7/2009
KR 10-2009-0092466 A 9/2009
KR 2009-0095741 A 9/2009
KR 2009-0114816 A 11/2009

OTHER PUBLICATIONS

Jung-Min Kim et al., "Compact Stripline-Fed Meander Slot Antenna", Electronics Letters, vol. 37, No. 16, pp. 995-996, Aug. 2001.

* cited by examiner

*Primary Examiner* — Hoang V Nguyen
(74) *Attorney, Agent, or Firm* — Rabin & Berdo, P.C.

(57) ABSTRACT

A small antenna using an SRR structure in a wireless communication system includes: a first radiation unit positioned over a dielectric substrate formed of a predetermined dielectric medium and having a predetermined ring shape; a feed unit positioned over the dielectric substrate and configured to feed a signal to the first radiation unit; a second radiation unit positioned under the dielectric substrate and having a predetermined ring shape; a via formed through the dielectric substrate to connect the first and second radiation units; a ground unit positioned under the dielectric substrate and configured to ground the first and second radiation units; and a metal line unit positioned under the dielectric substrate to connect the second radiation unit and the ground unit. The feed unit includes first and second capacitors which accomplish impedance matching when the signal is fed to the first radiation unit.

16 Claims, 5 Drawing Sheets

SMALL ANTENNA USING SRR STRUCTURE IN WIRELESS COMMUNICATION SYSTEM AND METHOD FOR MANUFACTURING THE SAME

CROSS-REFERENCE(S) TO RELATED APPLICATIONS

The present application claims priority of Korean Patent Application No. 10-2009-0117393, filed on Nov. 30, 2009, which is incorporated herein by reference in its entirety.

BACKGROUND OF THE INVENTION

1. Field of the Invention

Exemplary embodiments of the present invention relate to a wireless communication system; and, more particularly, to a small antenna which controls a resonant frequency using a split ring resonator (hereafter, referred to as SRR) structure in a wireless communication system, and a method for manufacturing the same.

2. Description of Related Art

In order to transmit and receive signals in a wireless communication system, various types of antennas have been proposed. The antennas are essential components in a wireless communication system for transmitting and receiving electromagnetic wave signals, and resonate at a specific frequency of electromagnetic wave to transmit and receive an electromagnetic wave signal of the corresponding frequency. Recently, as the wireless communication system has rapidly developed, the antennas have been not only used in various manners, but have also been reduced in size.

In general, however, since a small antenna has a large reactance component and a very small radiation resistance value, it is difficult to accomplish impedance matching. Accordingly, since the small antenna has a very narrow impedance bandwidth and low efficiency, it exhibits a low gain characteristic. In order to accomplish the impedance matching of the small antenna, an additional matching network is required in an antenna feed unit. This may increase the cost and time as well as the complexity when the small antenna is implemented. Furthermore, when the additional matching network is provided for the impedance matching of the small antenna, a resistance loss may occur because the additional matching network is included in a matching circuit of the small antenna. The resistance loss may reduce the efficiency of the small antenna, and the additional matching network may increase the entire size of the small antenna.

For example, a general small antenna has a primary-mode resonant structure and an electrical length of half a wavelength with respect to a wavelength corresponding to a resonant frequency. Accordingly, when an electromagnetic wave guided along a wire in the small antenna forms a standing wave in the wire, resonance occurs. At this time, since the electrical length of the small antenna is decided depending on the resonant frequency, the size of the small antenna having the primary-mode resonant structure is changed in accordance with the resonant frequency. In particular, as the operation frequency decreases, the size of the small antenna may increase. To solve such a problem, a meander antenna has been proposed. However, the length of the meander antenna is also decided by the resonant frequency. Therefore, as the antenna is reduced in size, the complexity of the antenna inevitably increases. That is because the antenna having a fixed length should be formed in a limited small space.

Therefore, there is demand for a method for implementing a small antenna, which may easily accomplish the impedance matching without an additional matching network for the impedance matching of the small antenna, minimize the size and the implementation cost and time as well as the complexity of the antenna, and increase the antenna efficiency.

SUMMARY OF THE INVENTION

An embodiment of the present invention is directed to a small antenna capable of controlling a frequency in a wireless communication system and a method for manufacturing the same.

Another embodiment of the present invention is directed to a small antenna capable of easily controlling a frequency using an SRR structure in a wireless communication system and a method for manufacturing the same.

Another embodiment of the present invention is directed to a small antenna using an SRR structure in a wireless communication system, which does not require a matching network for impedance matching and has a simple structure, and a method for manufacturing the same.

Another embodiment of the present invention is directed to a small antenna using an SRR structure in a wireless communication system, which improves antenna efficiency through the SRR structure and minimizes the implementation cost and time, and a method for manufacturing the same.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a small antenna using an SRR structure in a wireless communication system includes: a first radiation unit positioned over a dielectric substrate formed of a predetermined dielectric medium and having a predetermined ring shape; a feed unit positioned over the dielectric substrate and configured to feed a signal to the first radiation unit; a second radiation unit positioned under the dielectric substrate and having a predetermined ring shape; a via formed through the dielectric substrate to connect the first and second radiation units; a ground unit positioned under the dielectric substrate and configured to ground the first and second radiation units; and a metal line unit positioned under the dielectric substrate to connect the second radiation unit and the ground unit. The feed unit includes first and second capacitors which accomplish impedance matching when the signal is fed to the first radiation unit.

In accordance with another embodiment of the present invention, a method for manufacturing a small antenna using an SRR structure in a wireless communication system includes forming a first radiation unit with a predetermined ring shape by patterning a metallic conductor over a dielectric substrate formed of a predetermined dielectric medium; forming a second radiation unit with a predetermined ring shape by patterning a metallic conductor under the dielectric substrate; forming a via through the dielectric substrate such that the via connects the first and second radiation units; forming a feed unit configured to feed a signal to the first radiation unit and a transfer line unit configured to transfer the signal to the feed unit over the dielectric substrate; forming a ground unit under the dielectric substrate, the ground unit configured to ground the first and second radiation units; and forming a metal line unit under the dielectric substrate, the metal line unit configured to connect the second radiation unit and the ground unit. When the signal is fed to the first radiation unit by the feed unit, first and second capacitances are generated to accomplish impedance matching.

DESCRIPTION OF SPECIFIC EMBODIMENTS

Figure 1:
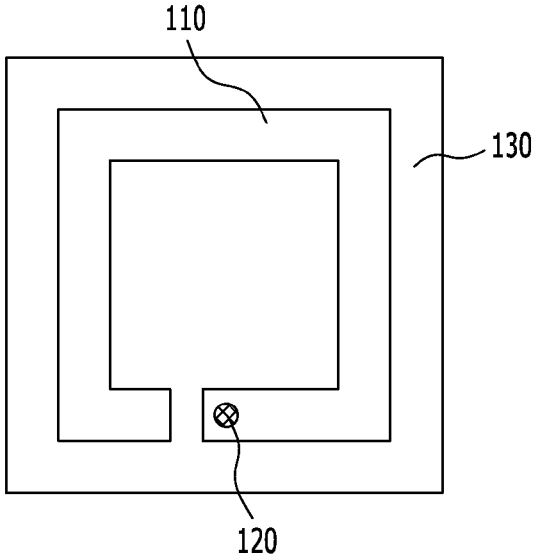
FIGS. 1 to 3 are diagrams schematically illustrating the structure of a small antenna using an SRR structure in a wireless communication system in accordance with an embodiment of the present invention.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Exemplary embodiments of the present invention provide a small antenna capable of controlling a frequency in a wireless communication system and a method for manufacturing the same. In the embodiments of the present invention, an SRR structure is used to implement the small antenna. The small antenna implemented by using the SRR structure easily controls a resonant frequency without a matching unit for impedance matching, for example, a matching network, and is implemented with a simple structure on a printed circuit board (hereafter, referred to as PCB).

The small antenna in accordance with the embodiment of the present invention includes a radiation unit and a feed unit which form the SRR structure. The feed unit of the small antenna using the SRR structure accomplishes impedance matching through a simple method, without an additional matching unit for the impedance matching. Therefore, it is possible to reduce the implementation cost and time when the small antenna is implemented. Furthermore, since the antenna has a simple structure, the design of the antenna may be simplified, which makes it possible to reduce the size of the antenna. In this embodiment of the present invention, since an inductance element connects the radiation unit and a ground substrate through the SRR structure, it is possible to easily control the resonant frequency of the antenna. Hereafter, the small antenna using the SRR structure in accordance with the embodiment of the present invention will be described in detail with reference to the accompanying drawings.

Figure 2:
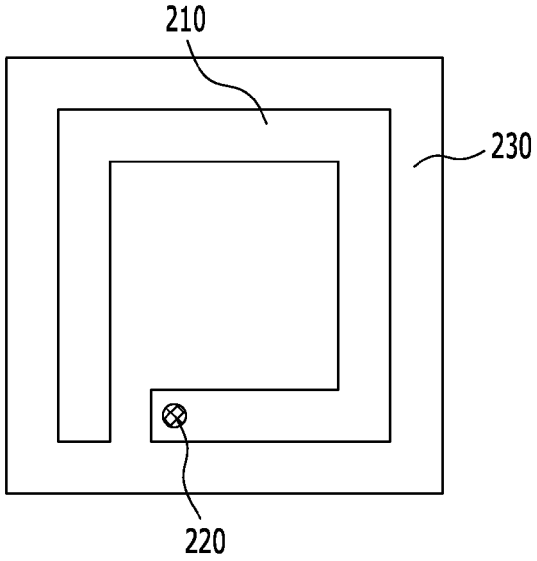
Figure 3:
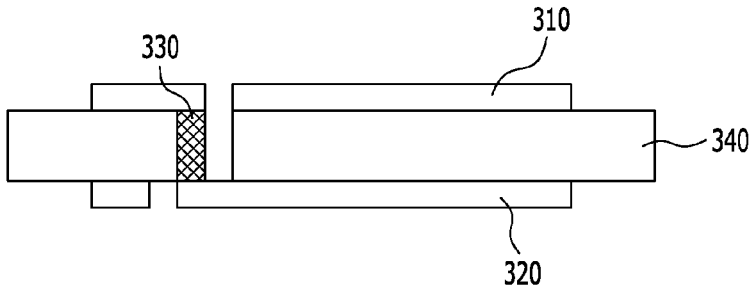

FIGS. 1 to 3 are diagrams schematically illustrating the structure of the small antenna using the SRR structure in a wireless communication system in accordance with the embodiment of the present invention. FIG. 1 is a diagram illustrating the upper part of a dielectric substrate of the small antenna using the SRR structure in accordance with the embodiment of the present invention. FIG. 2 is a diagram illustrating the lower part of the dielectric substrate of the small antenna using the SRR structure in accordance with the embodiment of the present invention. FIG. 3 is a diagram illustrating a side part of the dielectric substrate of the small antenna using the SRR structure in accordance with the embodiment of the present invention.

Referring to FIGS. 1 to 3, the small antenna using the SRR structure includes dielectric substrates 130 and 230 formed of a dielectric medium $\in_r$, first radiation units 110 and 310 formed over the dielectric substrates 130 and 230, and second radiation units 210 and 320 formed under the dielectric substrates 130 and 230, and vias 120, 220, and 330 formed through the dielectric substrates 130 and 230. The first radiation units 110 and 310 are formed of a metallic conductor having a predetermined size and a predetermined ring shape. The second radiation units 210 and 320 are formed of a metallic conductor having a predetermined size and a predetermined ring shape, like the first radiation units 110 and 310. The vias 120, 220, and 330 electrically connect the first radiation units 110 and 310 to the second radiation units 210 and 320. The size of the first radiation units 110 and 310 is independent of that of the second radiation units 210 and 320. The size of the first radiation units 110 and 310 and the size of the second radiation units 210 and 320 may be decided in correspondence to the resonant frequency of the small antenna which is required when the small antenna radiates a signal.

Figure 4:
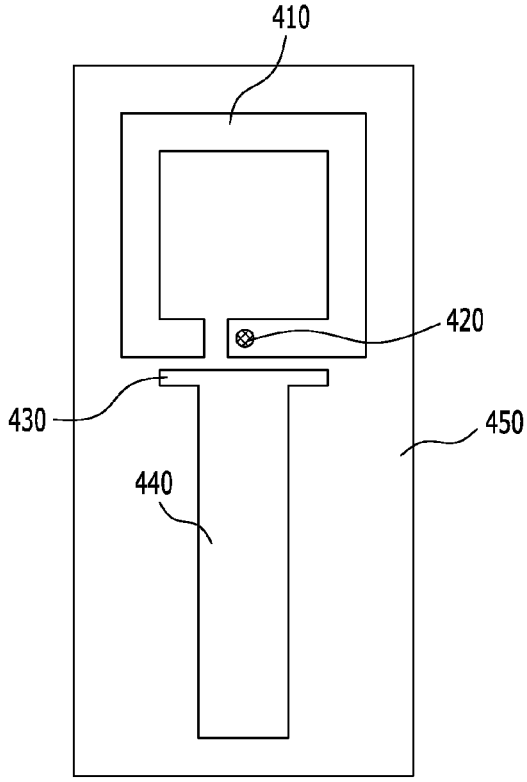
FIGS. 4 and 5 are diagrams schematically illustrating the feed and ground structure of the small antenna using the SRR structure in a wireless communication system in accordance with the embodiment of the present invention.
Figure 5:
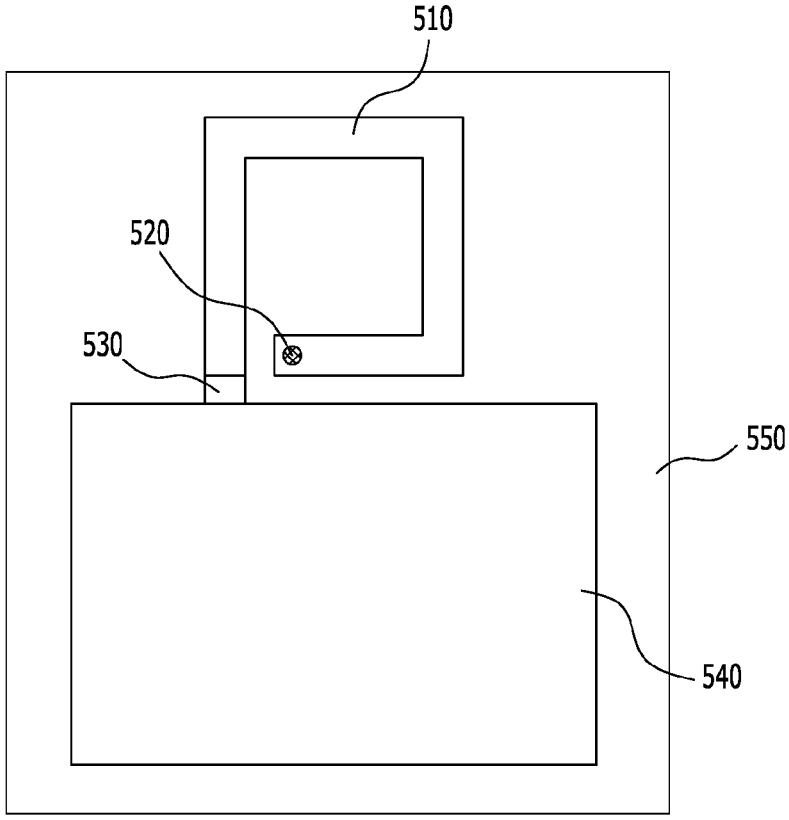

The small antenna has the SRR structure formed by the first radiation units 110 and 310 and the second radiation units 210 and 320. The first radiation units 110 and 310 and the second radiation units 210 and 320 may be formed in various ring shapes such as a rectangular ring, a triangular ring, and a circular ring. In the small antenna, when power is fed to the first radiation units 110 and 310, the first radiation units 110 and 130 radiate a signal. Then, the signal is fed to the second radiation units 210 and 320 through the vias 120, 220, and 330 such that the second radiation units 210 and 320 radiate a signal. That is, the small antenna radiates a signal through the first radiation units 110 and 310 and the second radiation units 210 and 320 forming the SRR structure. Referring to FIGS. 4 and 5, the feed and ground structure of the small antenna using the SRR structure in accordance with the embodiment of the present invention will be described in detail.

FIGS. 4 and 5 are diagrams schematically illustrating the feed and ground structure of the small antenna using the SRR structure in accordance with the embodiment of the present invention, showing the small antenna illustrated in FIGS. 1 to 3 and a feed unit and a ground substrate of the small antenna. FIG. 4 is a diagram illustrating the upper part of the dielectric substrate where the small antenna using the SRR structure, the feed unit, and the ground substrate are implemented. FIG. 5 is a diagram illustrating the lower part of the dielectric substrate where the small antenna using the SRR structure, the feed unit, and the ground substrate are implemented.

Referring to FIGS. 4 and 5, the small antenna using the SRR structure includes a first radiation unit 410, a feed unit 430, and a feed line unit 440 which are positioned over dielectric substrates 450 and 550 formed of a predetermined dielectric medium $\in_r$. The feed unit 430 is configured to feed a signal to the first radiation unit 410, and the feed line unit 440 is configured to transfer a signal such that the signal is fed through the feed unit 430. Furthermore, the small antenna using the SRR structure includes a second radiation unit 510, a ground unit 540, and a metal line unit 530 which are positioned under the dielectric substrates 450 and 550. The ground unit 540 serves as a ground substrate of the small antenna, and the metal line unit 530 connects the second radiation unit 510 and the ground unit 540. Furthermore, the small antenna using the SRR structure includes vias 420 and 520 formed through the dielectric substrates 450 and 550 to connect the first and second radiation units 410 and 510.

The feed line unit 440 has a characteristic impedance of 50Ω and serves as a transfer line of the signal fed to the first radiation unit 410 of the small antenna. The signal transferred through the transfer line is fed to the first radiation unit 410 through the feed unit 430, and also fed to the second radiation unit 510 through the vias 420 and 520. Accordingly, the small antenna radiates the signal through the first and second radiation units 410 and 510 forming the SRR structure.

The small antenna using the SRR antenna may accomplish matching through the feed unit 430 without an additional matching network. In particular, impedance matching is easily accomplished through the feed unit 430 and the feed line unit 440 having a characteristic impedance of 50Ω. Accordingly, the efficiency of the signal feed to the first and second radiation units 410 and 510 is not reduced, which makes it possible to improve the antenna efficiency. Furthermore, since the metal line unit 530 connects the second radiation unit 510 and the ground unit 540 serving as a ground substrate, the SRR structure formed by the first and second radiation units 410 and 510 forms a spiral inductor having a predetermined inductance value and has a predetermined inductance value. Furthermore, the metal line unit 530 operates as an inductance element, and the resonant frequency of the small antenna may be controlled depending on the inductance value of the SRR structure and the metal line unit 530. Now, referring to FIG. 6, the impedance matching and the fixed frequency control of the small antenna using the SRR structure in accordance with the embodiment of the present invention will be described in more detail.

Figure 6:
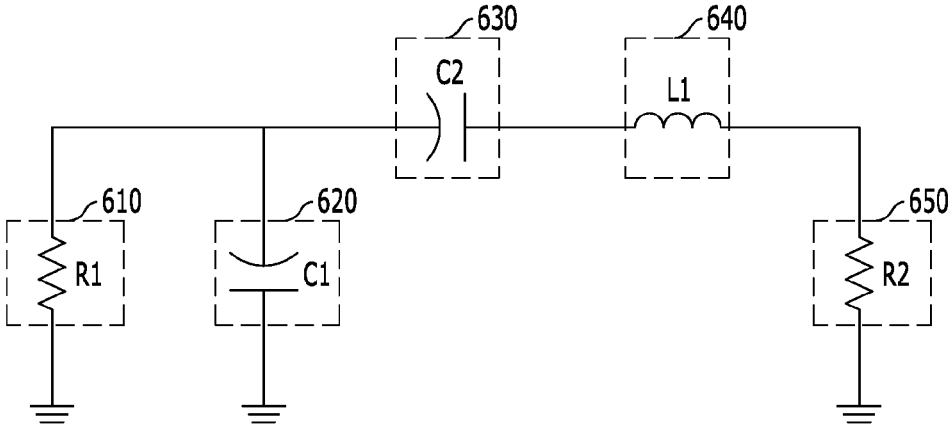
FIG. 6 is a diagram schematically illustrating an equivalent circuit of the small antenna using the SRR structure in accordance with the embodiment of the present invention.

FIG. 6 is a diagram schematically illustrating an equivalent circuit of the small antenna using the SRR structure in accordance with the embodiment of the present invention.

Referring to FIG. 6, the small antenna using the SRR structure includes a first resistor 610, a first capacitor 620, a second capacitor 630, an inductor 640, and a second resistor 650. The first resistor 610 corresponds to a resistance R1 of the characteristic impedance of the feed line unit 440. The first capacitor 620 corresponds to a capacitance C1 formed between the feed unit 430 and the ground unit 540. The second capacitor 630 corresponds to a capacitance C2 formed between the feed unit 430 and the first radiation unit 410 of the small antenna. The inductor 640 corresponds to the inductance L1 of the SRR structure and the metal line unit 530 which connects the second radiation unit 510 and the ground unit 540 and operates as an inductance element. The second resistor 650 corresponds to a radiation resistance R2 of the first and second radiation units 410 and 510. The inductance L1 is mainly decided by the SRR structure formed by the first and second radiation units 410 and 510, and additionally decided by adding the metal line unit 530 or a predetermined inductor.

In the small antenna using the SRR structure, the first and second radiation units 410 and 510 have a very small radiation resistance R2, and the metal line unit 530 has a large inductance L1. Therefore, although the impedance matching may be difficult to accomplish during the feed to the small antenna, the two capacitors 620 and 630 formed by the feed unit 430, that is, the second capacitor 630 connected in series to the first resistor 610 and the first capacitor 620 connected in parallel to the second resistor unit 620 may easily accomplish the impedance matching during the feed.

In the conventional technology, the matching network for impedance matching between small antenna elements and the first resistor 610 by the feed line unit 440 during the feed to the antennas was required. In the small antenna using the SRR structure in accordance with the embodiment of the present invention, however, the first and second capacitor units 620 and 630 are formed as a matching network by the feed unit 430. Accordingly, the small antenna using the SRR structure in accordance with the embodiment of the present invention may not only easily accomplish the impedance matching during the feed, but also implement the matching network only with the feed unit 430 without an additional matching network. Therefore, the structure of the antenna may be simplified, which makes it easy to design and implement the antenna. Furthermore, the implementation cost and time may be minimized, and a much smaller antenna may be implemented.

In the small antenna using the SRR structure, the second capacitor 630 formed by the feed unit 430 resonates with the inductor 640 which is formed by the metal line unit 530 and connected in series to the second capacitor 630, and forms frequency resonance. That is, the small antenna using the SRR structure accomplishes the impedance matching through the first and second capacitor units 610 and 620 as described above, and the second capacitor 630 and the inductor 640 form the frequency resonance.

At this time, the inductance value of the inductor 640 may be controlled by the metal line unit 530 connecting the second radiation unit 510 and the ground unit 540, and the resonant frequency of the second capacitor 630 and the inductor 640 is varied by the control of the inductance value. Therefore, when controlling the inductance value of the inductor 640 through the metal lie unit 530, the small antenna using the SRR structure may easily control the resonant frequency as well as the efficiency of the antenna. Now, referring to FIGS. 7 and 8, the efficiency and the resonant frequency control of the small antenna using the SRR structure in accordance with the embodiment of the present invention will be described in detail.

Figure 7:
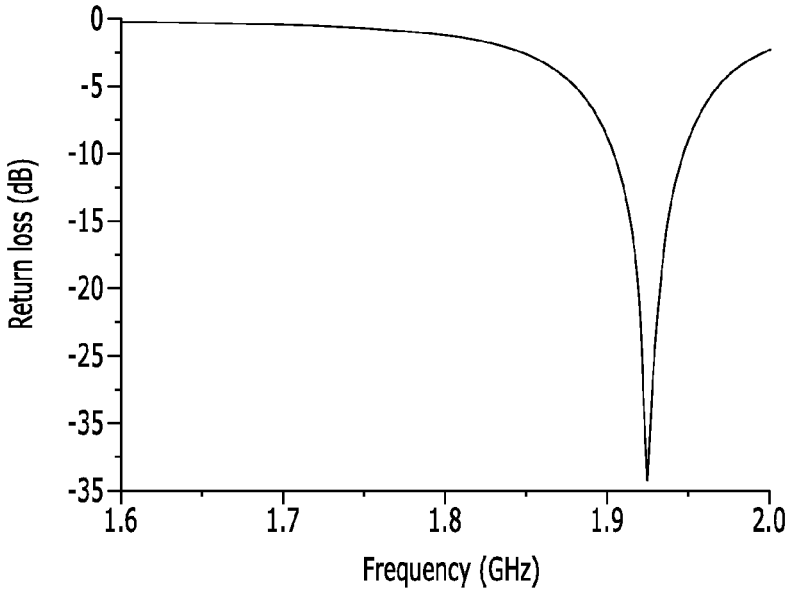
FIGS. 7 and 8 are graphs showing the efficiency of the small antenna using the SRR structure in accordance with the embodiment of the present invention
Figure 8:
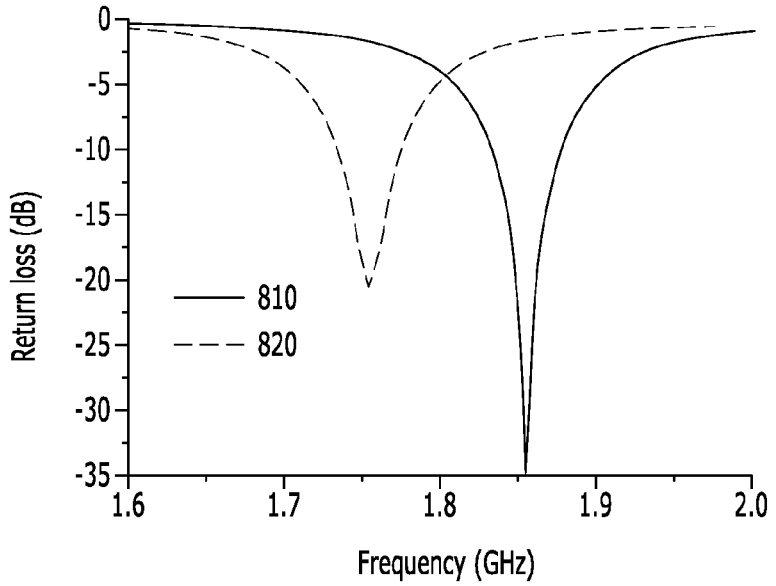

FIGS. 7 and 8 are graphs showing the efficiency of the small antenna using the SRR structure in accordance with the embodiment of the present invention. FIG. 7 is a graph showing a result obtained by simulating the small antenna using the SRR structure illustrated in FIGS. 4 and 5. FIG. 8 is a graph obtained by simulating variations in the resonant frequency corresponding to the control of the inductance value of the inductor 640 in the small antenna using the SRR structure in accordance with the embodiment of the present invention.

Referring to FIGS. 7 and 8, the small antenna using the SRR structure has a resonant frequency of 1.925 GHz when the first and second radiation units 410 and 420 have a ring size of 5 mm, and has a size of 0.03λ at a center frequency of 1.925 GHz. The small antenna using the SRR structure has a size which is 16.6 times reduced than a general half-wave antenna. Therefore, it is possible to implement a much smaller antenna.

Furthermore, when the inductance value of the inductor 640 is set to 1.2 nH, the small antenna using the SRR structure having the above-described ring size has a resonant frequency of 1.855 GHz. When the inductance value of the inductor 640 is set to 2.7 nH, the small antenna using the SRR structure has a resonant frequency of 1.755 GHz. Therefore, the small antenna using the SRR structure in accordance with the embodiment of the present invention may easily control the resonant frequency by changing the inductance value of the inductor 640 formed by the metal line unit 530 connecting the second radiation unit 510 and the ground unit 540. At this time, the signal radiated by the small antenna using the SRR structure has an omni-directional radiation pattern, and the small antenna using the SRR structure has a maximum gain of 1.9 dB. Furthermore, the small antenna using the SRR structure has a high antenna efficiency of 82%. Accordingly, it can be seen that the small antenna using the SRR structure improves the antenna efficiency. Now, a method for manufacturing the small antenna using the SRR structure in accordance with the embodiment of the present invention will be described in detail with reference to FIG. 9.

Figure 9:
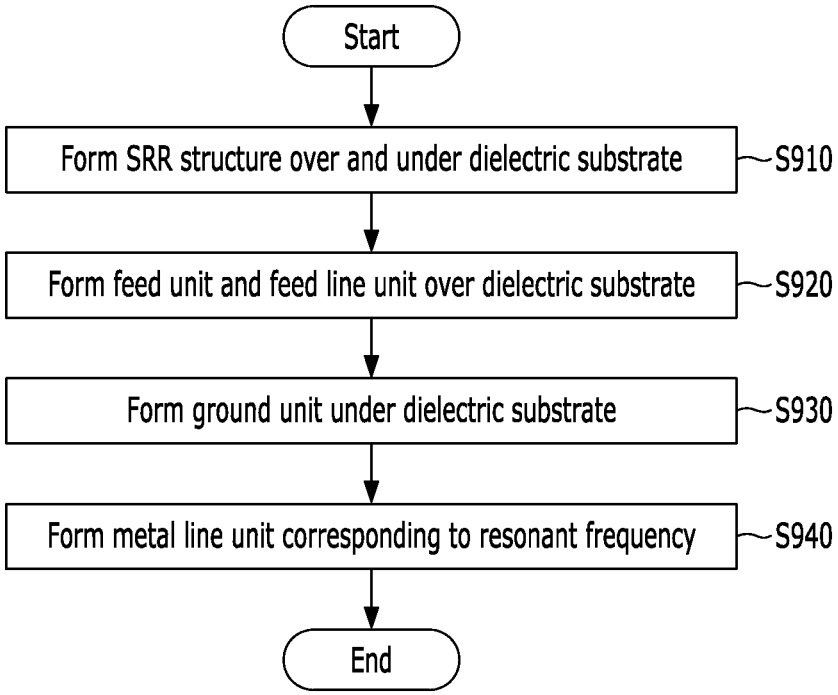
FIG. 9 is a flow chart explaining a method for manufacturing a small antenna using an SRR structure in a wireless communication system in accordance with another embodiment of the present invention.

FIG. 9 is a flow chart explaining a method for manufacturing the small antenna using the SRR structure in a wireless communication system in accordance with another embodiment of the present invention.

Referring to FIG. 9, in a step S910, a metallic conductor having a predetermined size and a predetermined ring shape is patterned over a dielectric substrate formed of a predetermined dielectric medium $\in_r$ to form the first radiation unit illustrated in FIG. 1, and another metallic conductor having a predetermined size and a predetermined ring shape like the first radiation unit is patterned under the dielectric substrate to form the second radiation unit illustrated in FIG. 2. Furthermore, as illustrated in FIG. 3, vias are formed through the dielectric substrate to electrically connect the first and second radiation units. That is, the first and second radiation units are formed over and under the dielectric substrate to form the SRR structure.

In this case, the size of the first radiation unit is independent of the size of the second radiation unit, and the sizes of the first and second radiation units may be decided in correspondence to the resonant frequency of the small antenna required when the antenna radiates a signal. The first and second radiation units may be patterned in various shapes such as a rectangular ring, a triangular ring, and a circular ring. When a signal is fed to any one of the first and second radiation units, the signal is fed to the other radiation unit through the vias. Accordingly, both of the first and second radiation units radiate a signal through the fed signal. The first and second radiation units have a very small radiation resistance during the signal radiation.

In a step S920, a feed unit and a feed line unit are formed over the dielectric substrate having the first radiation formed thereon, as illustrated in FIG. 4, in order to feed a signal to the first radiation unit. The feed line unit has a characteristic impedance of 50Ω, and series connection capacitance occurs between the first radiation unit and the feed unit.

In a step S930, a ground unit is formed under the dielectric substrate having the second radiation unit formed thereon, as illustrated in FIG. 5, such that the antenna is grounded to the ground unit. The ground unit serves as a ground substrate, and parallel connection capacitance occurs between the feed unit and the ground unit.

As the series connection capacitance between the feed unit and the first radiation unit and the parallel connection capacitance between the feed unit and the ground unit occur, a separate matching network for impedance matching is not required during the signal feed through the feed line unit and the feed unit. That is, the impedance matching during the signal feed of the antenna is easily accomplished by the series connection capacitance and the parallel connection capacitance. Accordingly, the small antenna using the SRR in accordance with the embodiment of the present invention may easily accomplish the impedance matching during the feed through the capacitance generated by the feed unit without an additional matching network for the impedance matching. Furthermore, the matching network may be implemented only with the feed unit without an additional matching network. Therefore, the structure of the antenna is simplified, which makes it easy to design and implement the antenna. Furthermore, the implementation cost and time may be minimized, and a much smaller antenna may be implemented.

In a step S940, a metal line unit is formed under the dielectric substrate having the second radiation unit and the ground unit formed thereon, as illustrated in FIG. 5, in order to accomplish the frequency resonance of the small antenna. At this time, the metal line unit is formed between the second radiation unit and the ground unit so as to connect the second radiation unit and the ground unit under the dielectric substrate. The metal line unit formed in such a manner operates as an inductor element having a predetermined inductance value, and inductance controlled by adding the inductance of the metal line unit to the inductance decided by the SRR structure and the series connection inductance formed by the feed unit and the ground unit form the frequency resonance. Accordingly, the small antenna having the SRR structure is completed.

The inductance value may be controlled by the metal line unit connecting the second radiation unit and the ground unit, and the resonant frequency formed by the series connection capacitance and the inductance is varied by the control of the inductance value. Therefore, the small antenna using the SRR structure in accordance with the embodiment of the present invention may easily control the resonant frequency by controlling the inductance value through the metal line unit.

In accordance with the embodiments of the present invention, the small antenna using the SRR structure in a wireless communication system may easily control the resonant frequency without an additional matching network for impedance matching. Furthermore, since the small antenna is implemented by using the SRR structure, the antenna efficiency may be improved, and the size and the implementation cost and time of the antenna may be minimized when the antenna is implemented. Furthermore, the small antenna using the SRR structure does not require an additional impedance matching unit. Therefore, the configuration of the antenna is simplified, which makes it easy to design the antenna. Accordingly, it is possible to reduce the size of the antenna.

While the present invention has been described with respect to the specific embodiments, it will be apparent to those skilled in the art that various changes and modifications may be made without departing from the spirit and scope of the invention as defined in the following claims.

What is claimed is:

1. A small antenna using a split ring resonator (SRR) structure in a wireless communication system, comprising:

a first radiation unit positioned over a dielectric substrate formed of a predetermined dielectric medium and having a predetermined ring shape;

a feed unit positioned over the dielectric substrate and configured to feed a signal to the first radiation unit;

a second radiation unit positioned under the dielectric substrate and having a predetermined ring shape;

a via formed through the dielectric substrate to connect the first and second radiation units;

a ground unit positioned under the dielectric substrate and configured to ground the first and second radiation units; and a metal line unit positioned under the dielectric substrate to connect the second radiation unit and the ground unit, wherein the feed unit comprises first and second capacitors which accomplish impedance matching when the signal is fed to the first radiation unit.

2. The small antenna of claim 1, wherein the first capacitor is formed by the feed unit and the first radiation unit, and the second capacitor is formed by the feed unit and the ground unit.

3. The small antenna of claim 2, wherein the metal line unit comprises an inductor which couples a predetermined inductance to an inductance formed by the first and second radiation units, and the inductances and the capacitance of the second capacitor form frequency resonance.

4. The small antenna of claim 3, wherein the inductor controls the resonant frequency of the antenna by changing the predetermined inductance.

5. The small antenna of claim 3, wherein the ring sizes of the first and second radiation units are independently decided in correspondence to the resonant frequency of the antenna.

6. The small antenna of claim 3, wherein the first and second radiation units comprises a resistor having a predetermined radiation resistance value, the second capacitor, the inductor, and the resistor are connected in series, and the first and second capacitors are connected in parallel.

7. The small antenna of claim 1, further comprising a transfer line unit positioned over the dielectric substrate to transfer the signal to the feed unit and having a characteristic impedance of 50Ω, wherein the transfer line unit comprises a resistor having the characteristic impedance of 50Ω, and the resistor is connected in parallel to the first capacitor and connected in series to the second capacitor.

8. The small antenna of claim 7, wherein the signal is fed to the first radiation unit by the feed unit, after being transferred to the feed unit through the transfer line unit, and then fed to the second radiation unit through the via.

9. A method for manufacturing a small antenna using an SRR structure in a wireless communication system, comprising:

forming a first radiation unit with a predetermined ring shape by patterning a metallic conductor over a dielectric substrate formed of a predetermined dielectric medium;

forming a second radiation unit with a predetermined ring shape by patterning a metallic conductor under the dielectric substrate;

forming a via through the dielectric substrate such that the via connects the first and second radiation units;

forming a feed unit configured to feed a signal to the first radiation unit and a transfer line unit configured to transfer the signal to the feed unit over the dielectric substrate;

forming a ground unit under the dielectric substrate, the ground unit configured to ground the first and second radiation units; and forming a metal line unit under the dielectric substrate, the metal line unit configured to connect the second radiation unit and the ground unit, wherein when the signal is fed to the first radiation unit by the feed unit, first and second capacitances are generated to accomplish impedance matching.

10. The method of claim 9, wherein the first capacitance is generated by the feed unit and the first radiation unit, and the second capacitance is generated by the feed unit and the ground unit.

11. The small antenna of claim 10, wherein the metal line unit has a predetermined inductance coupled to an inductance formed by the first radiation unit and the second radiation unit, and the inductances and the second capacitance form frequency resonance.

12. The small antenna of claim 11, wherein the predetermined inductance is varied by the metal line unit to control the resonance frequency of the antenna.

13. The small antenna of claim 11, wherein, in said forming a first radiation unit with a predetermined ring shape by patterning a metallic conductor over a dielectric substrate formed of a predetermined dielectric medium and said forming a second radiation unit with a predetermined ring shape by patterning a metallic conductor under the dielectric substrate, the ring sizes of the first and second radiation units are independently decided in correspondence to the resonant frequency of the antenna.

14. The small antenna of claim 11, wherein the first and second radiation units have a predetermined radiation resistance, the second capacitance, the inductance of the metal line unit, and the radiation resistance are connected in series, and the first capacitance and the second capacitance are connected in parallel.

15. The small antenna of claim 9, wherein the transfer line unit is configured to transfer the signal to the feed unit and has a characteristic impedance of 50Ω, the characteristic impedance of 50Ω and the first capacitance are connected in parallel, and the characteristic impedance of 50Ω and the second capacitance are connected in series.

16. The small antenna of claim 15, wherein the signal is fed to the first radiation unit by the feed unit, after being transferred to the feed unit through the transfer line unit, and then fed to the second radiation unit through the via.

* * * * *